US011814880B2

(12) United States Patent
Bajul et al.

(10) Patent No.: US 11,814,880 B2
(45) Date of Patent: Nov. 14, 2023

(54) EMERGENCY ACCESS DEVICE FOR VEHICLE OPENING PANEL HAVING A RETENTION LEVER AND A PULL WIRE

(71) Applicant: Vitesco Technologies GmbH, Regensburg (DE)

(72) Inventors: Xavier Bajul, Toulouse (FR); Aurélien Leboeuf, Toulouse (FR); Nicolas Lefrancq, Toulouse (FR)

(73) Assignee: Vitesco Technologies GmbH

( * ) Notice: Subject to any disclaimer, the term of this patent is extended or adjusted under 35 U.S.C. 154(b) by 0 days.

(21) Appl. No.: 17/912,667

(22) PCT Filed: May 20, 2021

(86) PCT No.: PCT/EP2021/063458
§ 371 (c)(1),
(2) Date: Sep. 19, 2022

(87) PCT Pub. No.: WO2021/239572
PCT Pub. Date: Dec. 2, 2021

(65) Prior Publication Data

US 2023/0193666 A1 Jun. 22, 2023

(30) Foreign Application Priority Data

May 29, 2020 (FR) ..... 2005686

(51) Int. Cl.
*E05B 81/90* (2014.01)
*E05B 85/10* (2014.01)
*E05B 51/00* (2006.01)

(52) U.S. Cl.
CPC ..... *E05B 81/90* (2013.01); *E05B 85/10* (2013.01); *E05B 51/005* (2013.01); *E05B 85/107* (2013.01)

(58) Field of Classification Search
CPC ..... E05B 81/90; E05B 81/76; E05B 81/28; E05B 85/10; E05B 85/103; E05B 85/107;
(Continued)

(56) References Cited

U.S. PATENT DOCUMENTS 2,803,479 A * 8/1957 Young ..... E05B 63/18 292/169.15
4,784,415 A * 11/1988 Malaval ..... E05B 47/00 292/144

(Continued)

FOREIGN PATENT DOCUMENTS

DE 102006018187 A1 * 10/2007
DE 102015108269 A1 * 12/2016

(Continued)

OTHER PUBLICATIONS

English Translation of Written Opinion for International Application No. PCT/EP2021/063458, dated Aug. 4, 2021, 4 pages.

(Continued)

*Primary Examiner* — David R Hare
*Assistant Examiner* — Emily G. Brown
(74) *Attorney, Agent, or Firm* — RatnerPrestia

(57) ABSTRACT

A vehicle opening panel emergency access device, having a graspable pull rod that is equipped with a retention strike; a retention lever that pivots relative to the sheath and has a bolt; a pull wire connected to the retention lever and designed to urge the retention lever by pulling it toward its release position; the graspable pull rod being mounted so as to be able to move in translation in the sheath according to three modes: a manual driving-in mode, a controlled driving-in mode, and an ejection mode.

14 Claims, 7 Drawing Sheets

(58) Field of Classification Search
CPC ..... E05B 85/22; E05B 85/24; E05B 79/20; E05B 79/22; E05B 77/02; E05B 77/10; E05B 77/12; E05B 63/0017; E05B 47/0009; E05B 47/06; E05B 47/0607; E05B 55/00; E05B 13/00; E05B 13/10; E05B 13/101; E05B 65/1066; E05B 51/005; E05B 17/2007; E05B 17/2023; E05B 17/2015; Y10T 292/1022; Y10T 292/1028; Y10T 292/11; E05C 1/14
See application file for complete search history.

(56) References Cited

U.S. PATENT DOCUMENTS

| | | | | |
|---|---|---|---|---|
| 6,584,817 | B1 * | 7/2003 | Lien | E05B 47/0603 292/144 |
| 8,403,376 | B2 * | 3/2013 | Greiner | E05B 63/0065 292/144 |
| 2004/0031301 | A1 * | 2/2004 | Dominique | E05B 41/00 70/237 |
| 2015/0315826 | A1 * | 11/2015 | Lang | E05B 85/103 49/503 |
| 2016/0305164 | A1 | 10/2016 | Bendel | |
| 2016/0333614 | A1 * | 11/2016 | Bendel | E05B 53/001 |
| 2019/0169889 | A1 * | 6/2019 | Beck | E05B 77/02 |
| 2020/0102773 | A1 * | 4/2020 | Sobecki | E05B 85/103 |
| 2021/0062539 | A1 * | 3/2021 | Chen | E05B 15/10 |
| 2022/0136289 | A1 * | 5/2022 | Guerin | E05B 77/02 70/279.1 |

FOREIGN PATENT DOCUMENTS

| | | | | |
|---|---|---|---|---|
| DE | 102018104421 | A1 | | 8/2019 |
| EP | 1072466 | A2 | * | 1/2001 |
| EP | 1279784 | A1 | * | 1/2003 |
| EP | 1279784 | A1 | | 1/2003 |
| FR | 2971536 | A1 | | 8/2012 |
| FR | 3026131 | A1 | | 3/2016 |
| FR | 3081485 | A1 | | 11/2019 |
| GB | 2286223 | A | * | 8/1995 |
| KR | 20100115274 | A | * | 10/2010 |
| WO | 2015062586 | A1 | | 5/2015 |
| WO | 2018024405 | A1 | | 2/2018 |

OTHER PUBLICATIONS

International Search Report and Written Opinion for International Application No. PCT/EP2021/063458, dated Aug. 4, 2021, with partial translation, 7 pages.

* cited by examiner

EMERGENCY ACCESS DEVICE FOR VEHICLE OPENING PANEL HAVING A RETENTION LEVER AND A PULL WIRE

CROSS REFERENCE TO RELATED APPLICATIONS

This application is the U.S. National Phase Application of PCT International Application No. PCT/EP2021/063458, filed May 20, 2021, which claims priority to French Patent Application No. 2005686, filed May 29, 2020, the contents of such applications being incorporated by reference herein.

FIELD OF THE INVENTION

The invention relates to the automotive field and targets an emergency access device associated with a vehicle opening panel.

BACKGROUND OF THE INVENTION

In order to allow access to a motor vehicle, for example, opening panels such as the doors are equipped with access devices. The most common access devices are handles that are mechanically connected to a lock such that actuation of the handle by the user actuates the lock and allows opening.

Furthermore, more advanced access devices currently exist in which no mechanical connection is required for normal operation of the access device. These devices generally have a sensor for sensing the presence of the user's hand. If the user is authorized to open the vehicle, for example if he or she is carrying a required fob, the vehicle then actuates an electric strike in the lock of the opening panel and thus allows access to the vehicle.

These access devices allow a reduction in mass, bulk and cost and also greater comfort of use since no physical connection with the lock is necessary in normal operation. However, for safety reasons in particular, these access devices nevertheless require an emergency access device providing a mechanical connection with the lock of the opening panel in the event of an emergency or of an electrical breakdown.

Vehicles equipped with access devices having no mechanical connection, in normal operation, between the handle of an opening panel and its lock are known. These known devices have an emergency access device having a mechanical and retractable means for actuating the lock.

SUMMARY OF THE INVENTION

The aim of an aspect of the invention is to improve the emergency access devices of the prior art so as to allow opening, in the event of an emergency, of an opening panel equipped with an access device having no mechanical connection between the handle and the lock of the opening panel.

To this end, an aspect of the invention targets a vehicle opening panel emergency access device, having:

- a graspable pull rod that is equipped with a retention strike and that is connected to a lock actuator, this graspable pull rod being designed to occupy: a retracted position in which the graspable pull rod is stowed in a sheath; and a deployed position in which the graspable pull rod is outside the sheath;
- a first elastic member that urges the graspable pull rod toward its deployed position;

- a retention lever that pivots relative to the sheath and has a bolt, the retention lever being designed to occupy: a blocking position in which the bolt is disposed in the retention strike, keeping the graspable pull rod in its retracted position; and a position for releasing the graspable pull rod in which the bolt is outside the retention strike;
- a second elastic member that urges the retention lever toward its blocking position;
- a pull wire connected to the retention lever and designed to urge the retention lever by pulling it toward its release position.

The graspable pull rod is mounted so as to be able to move in translation in the sheath according to three modes:

- a manual driving-in mode in which the graspable pull rod is pushed back into the sheath against the first elastic member, the retention strike urging the retention lever by pivoting it toward its release position, against the second elastic member;
- a controlled driving-in mode in which the pull wire urges the retention lever by pulling it toward its release position, the graspable pull rod being pushed back into the sheath, against the second elastic member, by the bolt that drives the retention strike;
- an ejection mode in which the graspable pull rod is moved in translation in an ejection direction, under the effect of the first elastic member, from its stowed position toward its ejected position.

The emergency access device according to an aspect of the invention performs two separate functions, for example within a vehicle:

- in the event of the vehicle being in an accident, an opening panel such as a door of the vehicle has to be able to be opened from the outside by the emergency services. The doors have generally been unlocked during the accident. The vehicle also controls an electric ejector function of the emergency access device such that the pull rod is released and occupies its deployed position. Such triggering of the device is here termed "controlled triggering". The opening panel is thus ready to be opened manually from the outside by virtue of the mechanical connection provided by the pull rod that is ready to be grasped;
- in the event that the vehicle no longer has the necessary electrical energy (discharged battery, for example), the user can manually actuate the emergency access device, according to a mechanical ejector function that releases the pull rod so that it occupies its deployed position and can be actuated by the user. Such triggering of the device is here termed "manual triggering".

The emergency access device according to an aspect of the invention performs these two functions with a small number of components, thus ensuring reduced bulk and costs and also increased reliability.

Specifically, the electric ejector has a single central component (the retention lever) that allows both controlled triggering and manual triggering. In the event of manual triggering, the retention lever is directly actuated by the movement of the pull rod, which is itself actuated by the user, and in the event of controlled triggering, the movement of the pull rod is directly controlled by the retention lever, which is itself actuated by pulling of the pull wire.

An extremely compact format is thus obtained for the emergency access device by virtue of a significant reduction in the number of moving mechanical components thereof, which is made possible by direct cooperation between the manual ejector and the controlled ejector.

The emergency access device according to an aspect of the invention may have the following additional features, alone or in combination:

- the pull wire is made of shape memory alloy, the retention lever being pulled toward its release position by shortening of the pull wire;
- the device has a means for heating the pull wire by circulation of an electric current in the pull wire;
- the pull wire has two ends fastened side by side to a stop, the pull wire surrounding the retention lever at a groove;
- the groove has a double curvature with orthogonal axes;
- the groove is framed by two flanges for restraining the pull wire when the retention lever is in its release position;
- the two ends of the pull wire are crimped onto electrical connectors fastened in the stops;
- the retention strike has two opposite walls respectively defining a manual triggering surface and a controlled triggering surface; the bolt being blocked against the controlled triggering wall when the retention lever is in its blocking position; the manual triggering surface urging the retention lever by pivoting it toward its release position during the manual driving-in mode; the bolt pushing the controlled triggering surface back during the controlled driving-in mode;
- the bolt has an oblique surface that cooperates with the controlled triggering surface;
- the controlled triggering surface has the same inclination as the oblique surface of the bolt;
- the manual triggering surface is oblique and forms a track for the bolt during the manual driving-in mode.

According to another aspect, the invention targets a motor vehicle door comprising a vehicle opening panel emergency access device as described above.

According to another aspect, the invention targets a motor vehicle comprising a vehicle opening panel emergency access device as described above.

BRIEF DESCRIPTION OF THE FIGURES

Other features and advantages of aspects of the invention will become apparent from the following non-limiting description, with reference to the appended drawings, in which.

DETAILED DESCRIPTION OF THE PREFERRED EMBODIMENTS

Figure 1:
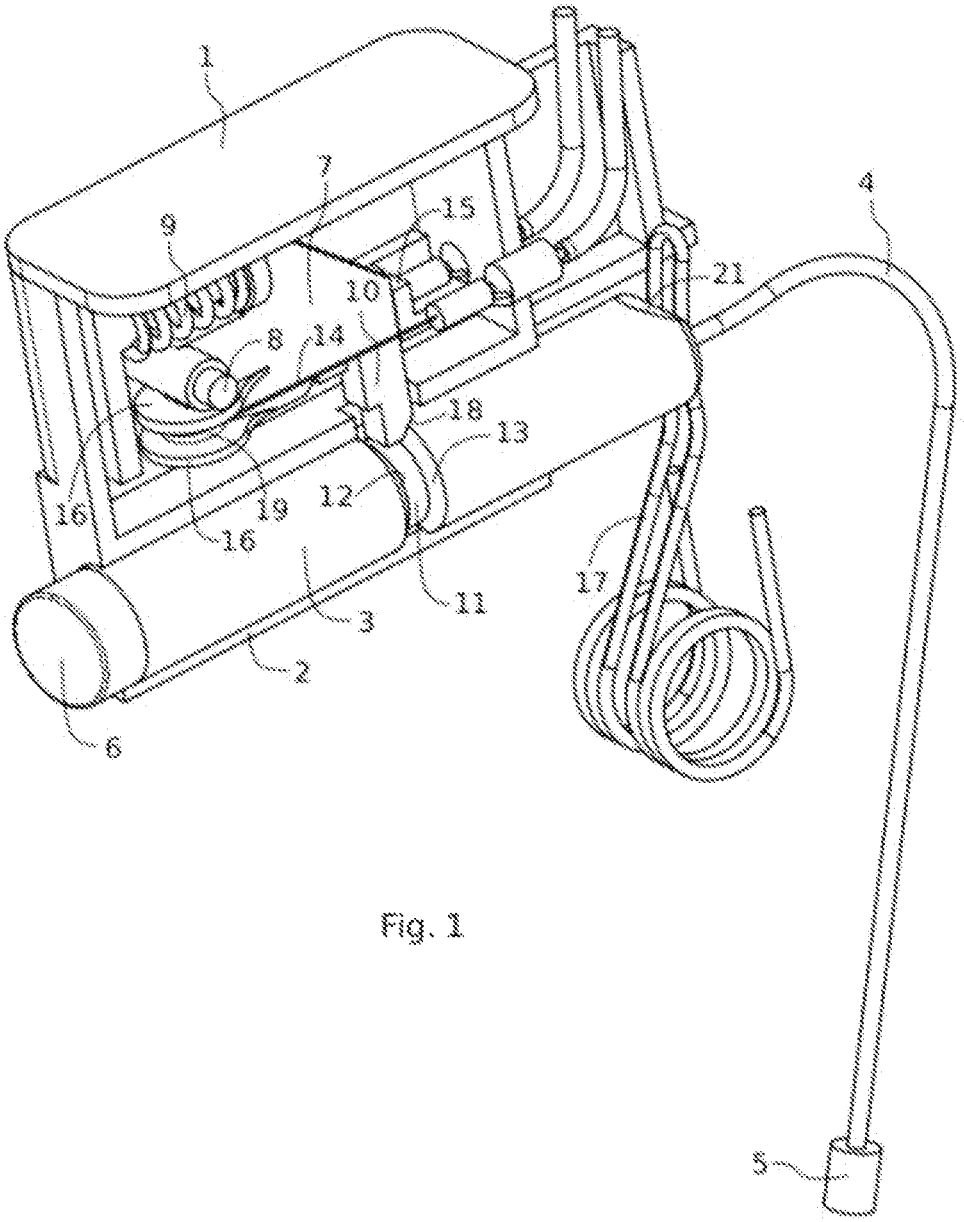
FIG. 1 shows a perspective view of an emergency access device according to an aspect of the invention.

FIG. 1 shows a perspective view of a vehicle opening panel emergency access device according to an aspect of the invention, in partial cross section along a vertical plane. This view shows the various elements constituting the device and its internal arrangement. This emergency access device is intended to be concealed inside a vehicle handle that has no mechanical element for actuation of the locks, so as to provide an emergency mechanical link.

The emergency access device has an enclosure 1 (viewed in cross section in FIG. 1) grouping together all the elements of the device. The enclosure 1 has a cylindrical sheath 2 in which a graspable pull rod 3 is disposed. The graspable pull rod 3 is connected to a lock actuator that is constituted in this case of a cable 4 of which the end 5 is fastened to a mechanism for actuation of the lock (not shown) that the emergency access device is intended to unlock in the event of an emergency.

The graspable pull rod 3 has an actuating end 6 that projects outside the sheath 2. The enclosure 1 is fastened inside the handle without a mechanism of the vehicle, such that the actuating end 6 of the graspable pull rod 3 is accessible to the user.

The device also has a retention lever 7 mounted so as to be able to pivot about a shaft 8 as one with the enclosure 1. The retention lever 7 is designed to block or release the pull rod 3.

The pull rod 3 has for this purpose a retention strike 11 constituted in this case of a groove made in its cylindrical profile, this groove being delimited by two opposite walls that respectively define a first surface 12 intended to play a role during the manual triggering of the device (referred to as "manual triggering surface 12") and a second surface 13 intended to play a role during the controlled triggering of the device (referred to as "controlled triggering surface 13"). Specifically, the retention lever 7 will be actuated by pivoting by the manual triggering surface 12 when the device is triggered manually, and by the controlled triggering surface 13 when the device is the subject of a controlled triggering.

The lever 7 has an end tooth forming a bolt 10 designed to cooperate with the strike 11. The retention lever 7 is able to pivot about its shaft 8 between a blocking position in which the bolt 10 is disposed in the strike 11 (position illustrated in FIG. 1) and a release position in which the lever 7 is pivoted upward such that the bolt 10 is outside the strike 11.

An elastic member constituted in this case of a compression spring 9 urges the lever 7 toward its blocking position.

The device has a pull wire 14 designed to pull on the retention lever 7 so as to pivot it from its blocking position to its release position. In the present example, the pull wire 14 is constituted of a wire stretched between two stops 15 (only one of these stops 15 is shown in the cross section in FIG. 1) on the one hand, and the retention lever 7 on the other hand. The pull wire 14 is passed around the retention lever 7 at a groove 19 framed by two flanges 16. A particularly compact arrangement is in this case obtained by a groove 19 extending in a plane parallel to the shaft 8.

In a particularly advantageous exemplary embodiment, the pull wire 14 is made of shape memory alloy ("SMA"). In the present description and the claims, the expression "shape memory alloy" is used exclusively in its sense denoting a material designed to assume a defined shape by heating. The pull wire 14 is made, for example, of shape memory nickel-titanium alloy. The pull wire 14 thus has what is called an "elongate" shape when the device is not the subject of a controlled triggering (as in FIG. 1), and what is called a "shortened" shape when the device is the subject of a controlled triggering.

The shape memory alloy of the pull wire 14 can have a one-way memory effect, i.e. the wire 14 comes into the shortened position when it is heated and the spring 9 brings it back to its elongate position when the heating of the wire 14 is stopped. As a variant, the shape memory alloy of the wire 14 can have a two-way memory effect, i.e. the wire 14 has a shortened length when it is above a certain temperature, and returns to an elongate length when it is below this temperature.

In one embodiment that is advantageous as a result of its compactness and the small number of components that it involves, the pull wire 14 is heated by the Joule effect, directly by the application of a current between its two ends. Two conductors 17 are crimped at the two ends of the pull wire 14, and these crimps are engaged in the stops 15.

An elastic member constituted in this case of a torsion spring 17 urges the graspable pull rod 3 toward its deployed position. The torsion spring 17 is mounted on a fixed part (not shown) that can be as one with the enclosure 1 or another element of the vehicle, fixed relative to the enclosure 1.

FIGS. 2 to 6 illustrate various sequences allowing the triggering of the emergency access device in FIG. 1. These figures are cross-sectional profile views of the device.

Figure 2:
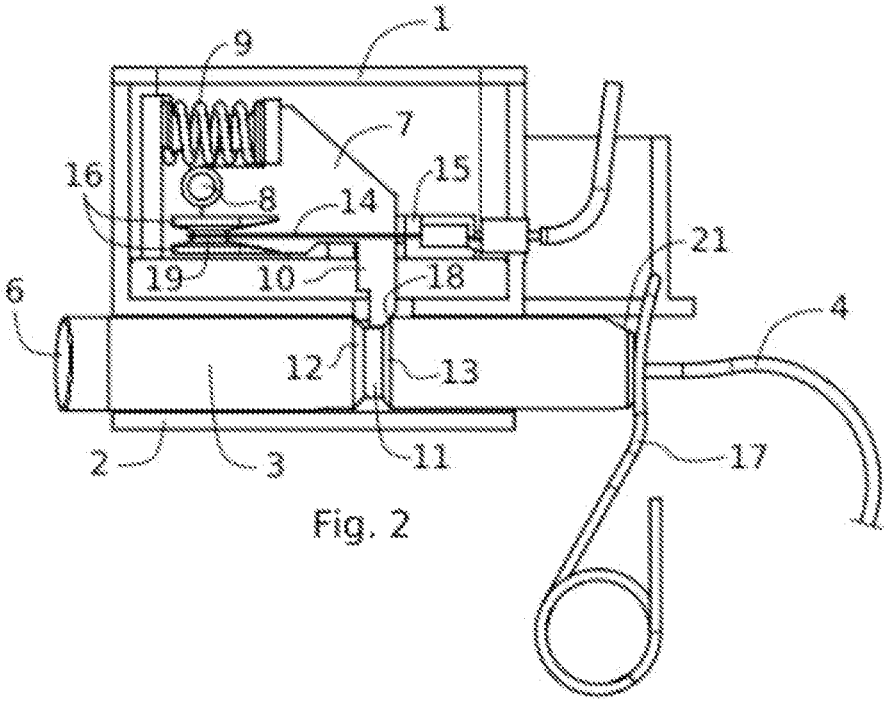
FIG. 2 is a cross-sectional view of the emergency access device in FIG. 1.

FIG. 2 shows the emergency access device in its position in FIG. 1, the graspable pull rod 3 being in the position in which it is retracted in the sheath 2 and the retention lever 7 being in the blocking position thus keeping the pull rod 3 in its retracted position. This position of the emergency access device corresponds to normal use of the vehicle in which the emergency access device is not used and remains ready to be triggered if needed.

In this position in FIG. 2, the controlled triggering surface 13 is urged against the bolt 10 of the retention lever 7 by the action of the torsion spring 17. The controlled triggering surface 13 acts, in this case, as a blocking surface to keep the pull rod 3 in its retracted position. The bolt 10 has a slope formed by an oblique surface 18 that is complementary to the controlled triggering surface 13. The controlled triggering surface 13 is also oblique (the controlled triggering surface 13 is in this case a portion of a cone) and its profile forms an angle identical to the angle formed by the oblique surface 18. The angle of these oblique surfaces has to make it possible for:

- the controlled triggering surface 13 to perform its blocking surface function and prevent the pull rod 3 from causing, under the action of the torsion spring 17, lifting of the retention lever 7, i.e. these oblique surfaces should not be too close to the horizontal;
- the bolt 10 to be able to push the graspable pull rod 3 back against the torsion spring 17 and be freed from the strike 11 (as explained below for the controlled driving-in mode), i.e. these oblique surfaces should not be too close to the vertical.

Preferably, the oblique surface 18 of the bolt 10 and the complementary oblique surface of the controlled triggering surface 13 are inclined by an angle of the order of 45°.

The manual triggering surface 12 also has a surface that is oblique with respect to the plane perpendicular to the longitudinal axis of the pull rod 3. The profile of this oblique surface forms a track for the actuation of the bolt, as explained below for the manual driving-in mode.

In the position in FIG. 2, the pull wire 14 is at ambient temperature and is configured to have a length adjusted to its path between the stops 15 and the bottom of the groove 19, in its elongate position.

Figure 3:
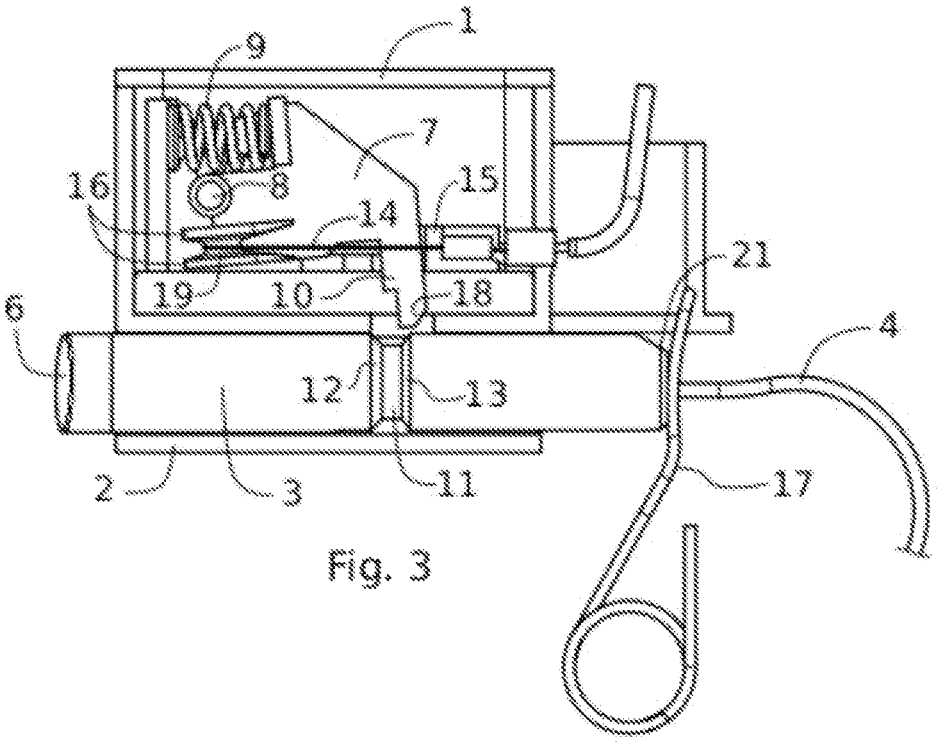
FIG. 3 shows the device in FIG. 2, in controlled driving-in mode.
Figure 4:
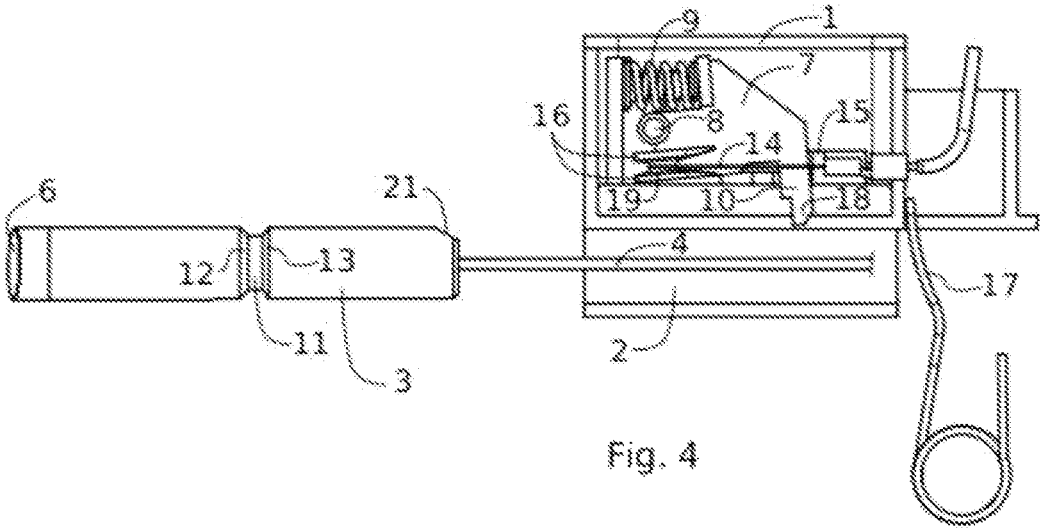
FIG. 4 shows the device in FIG. 2, in ejection mode.
Figure 5:
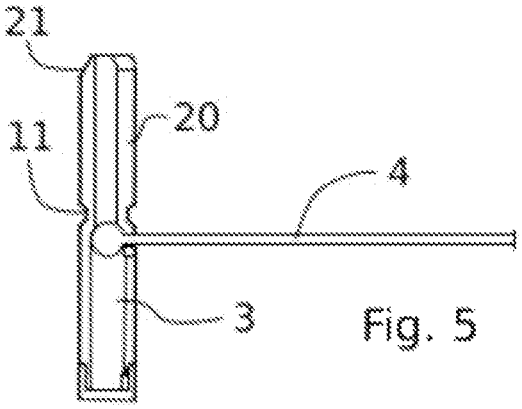
FIG. 5 shows the graspable pull rod in FIG. 2, after tilting.

FIGS. 3 to 5 illustrate the electrically controlled triggering of the emergency access device. This controlled triggering takes place when an electronic control unit of the vehicle detects an event such as an accident and controls the emergency access device for the automatic ejection of the graspable pull rod 3. In this context, a sufficiently large current is applied to the pull wire 14 so that it heats beyond its state change temperature and assumes its shortened form. In the present example, a nickel-titanium alloy wire 14 that is 0.2 mm in diameter is heated to approximately 150° under a voltage of 1.3 V and a current of 0.4 A. These values are perfectly compatible with the electrical energy available for an emergency triggering application in a motor vehicle. Such a temperature of 150°, although low enough to be reached quickly in such a wire 14, is moreover much higher than the maximum temperature of use of the vehicle (generally approximately 85°) and unwanted pulling of the wire 14 due to atmospheric conditions is therefore avoided.

The pulling of the wire 14 causes the retention lever 7 to pivot about its shaft 8, leading it to its release position. This pivoting of the retention lever 7 causes the pull rod 3 to move in translation according to a controlled driving-in mode. During the pulling of the wire 14, the pull rod 3 is pushed back into the sheath 2, against the torsion spring 17, such that the bolt 10 pushes, with its oblique surface 18, the controlled triggering surface 13 back. During this pushing-back operation, the oblique surface 18 and the controlled triggering surface 13 cooperate in particular by friction and sliding as far as the release position in FIG. 3.

The groove 19 and its flanges 16 advantageously have a diabolo shape, with a double curvature with orthogonal axes, allowing on the one hand the pull wire 14 to go around the retention lever 7 while resting on a curved surface, and allowing on the other hand the relative pivoting of the retention lever 7 of the pull wire 14.

The position shown in FIG. 3 is controlled release position, in which the retention lever 7 has reached its release state. The graspable pull rod 3 is then immediately ejected under the effect of the torsion spring 17, and this leads to the position in FIG. 4. In this ejection mode, the pull rod 3 is moved in translation in an ejection direction, opposite to the driving-in direction.

In FIG. 4, the pull rod 3 has been ejected and is now in the deployed position, outside the sheath 2. The current applied to the pull wire 14 is then stopped and the latter returns to its elongate shape in FIG. 2, by itself or under the effect of the compression spring 9.

From this position in FIG. 4, the pull rod 3 is preferably weighted such that it pivots vertically relative to the cable (see FIG. 5) by virtue of a slot 20. The graspable pull rod 3 is thus ready to be grasped between two fingers of the user in order to pull on the cable 4 so as to control the unlocking of a lock.

In the event of manual rearming of the emergency access device, the graspable pull rod 3 has a beveled surface 21 designed to pivot the retention lever 7 during the reintroduction of the graspable pull rod 3 into its sheath 2.

Figure 6:
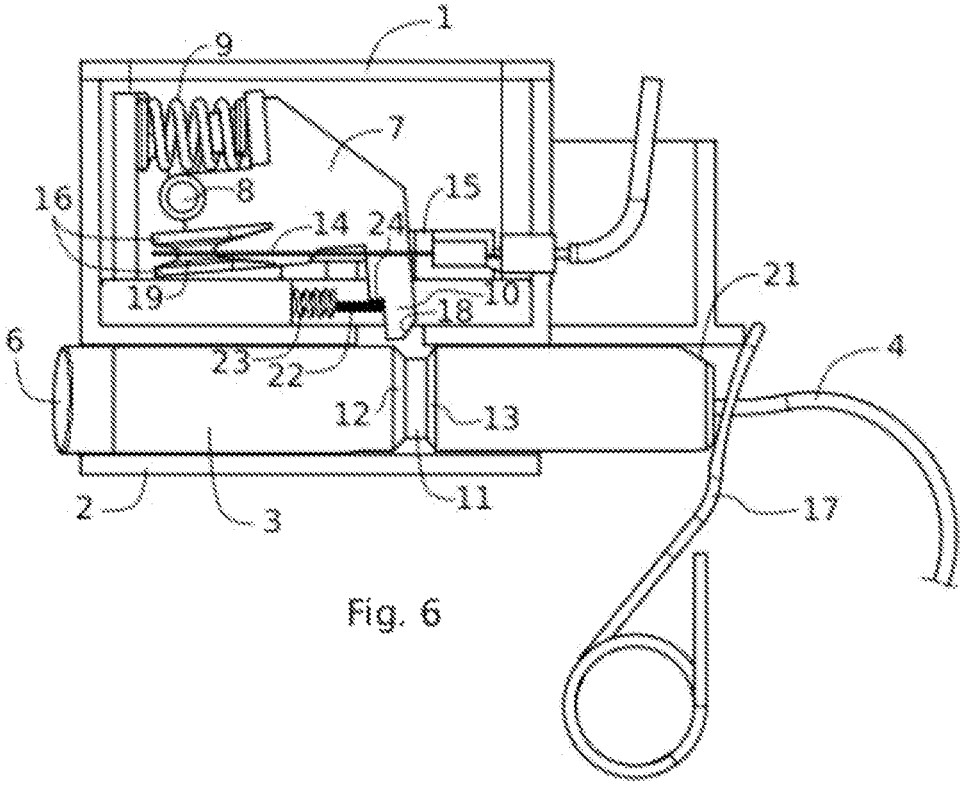
FIG. 6 shows the device in FIG. 2, in manual driving-in mode.

FIG. 6 illustrates the manual triggering of the emergency access device. When the user wishes to manually trigger the ejection of the graspable pull rod 3, in the event of battery failure for example, he or she pushes the graspable pull rod 3 back into its sheath 2 by exerting pressure on its actuating end 6. The pull rod 3 is then able to move in translation in the sheath 2 according to a manual driving-in mode, against the torsion spring 17, such that the manual triggering surface 12 pushes the bolt 10 back and causes the retention lever 7 to pivot. During this pivoting, the bolt 10 then slides on the oblique surface constituted by the manual triggering surface 12, and this causes the retention lever 7 to pivot as far as its release position.

From this position in FIG. 6, the graspable pull rod 3 is then ejected under the effect of the torsion spring 17. Optionally, so as to prevent the bolt 10 from returning to the strike 11 during the ejection of the graspable pull rod 3, it is possible to provide a pawl for blocking the retention lever 7 in its release position (schematically shown by a blocking tooth 22 and a spring 23, cooperating with a discontinuity 24 in the bolt 10). This pawl can optionally be automatically disengageable for the return of the retention lever 7 to its blocking position once the pull rod 3 has been ejected.

The flanges 16 surrounding the groove 19 are dimensioned such that, during this manual ejection, the pull wire 14 (which remains in its elongate shape) cannot come out of its housing in the groove 19, thus ensuring the correct return of the pull wire 14 to its position in the groove 19, during the return of the retention lever 7 to its blocking position.

From the position in FIG. 6, the graspable pull rod 3 is then ejected in the same way as for FIGS. 4 and 5.

The emergency access device can thus be triggered manually or in a controlled manner, by a manual driving-in mode or a controlled driving-in mode for the pull rod 3 that urges the two springs 9, 17 in a single operation. These two driving-in modes do not interfere with one another, while at the same time sharing the same mechanical implementation elements, the reduced number of which ensures the compactness of the enclosure 1.

Figure 7:
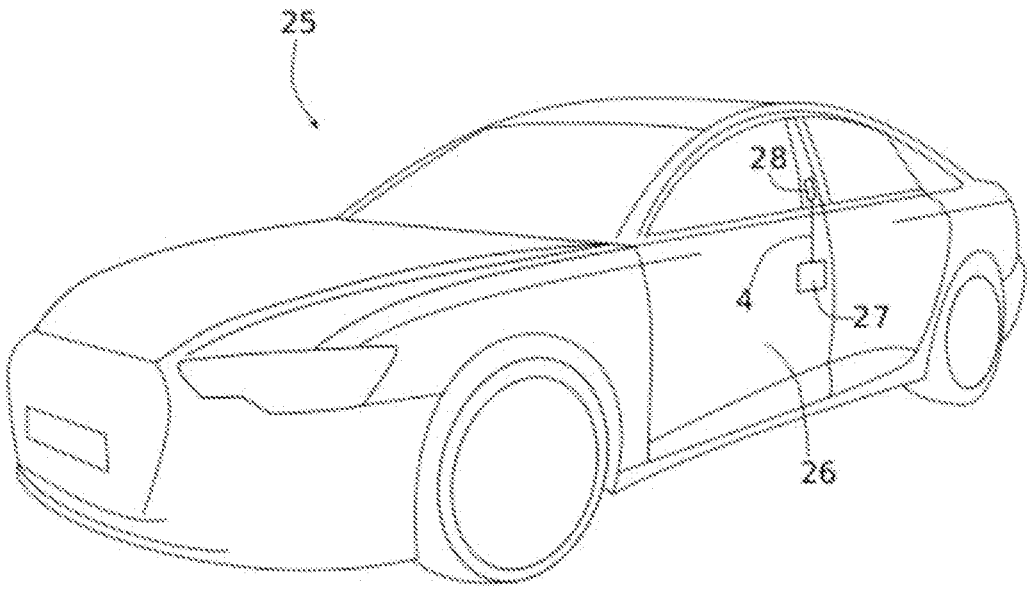
FIG. 7 schematically illustrates a motor vehicle of which one of the opening panels is equipped with an emergency access device according to an aspect of the invention.

FIG. 7 is a general view of a motor vehicle 25 equipped with an emergency access device 28 such as the one described above. The vehicle 25 is provided with an opening panel 26 (which in this example is a door) having a lock 27 connected to the emergency access device 28 by the cable 4.

Variant embodiments of the vehicle opening panel emergency access device may be implemented without departing from the scope of the invention. In particular, the pull wire 14 can be shortened by any other suitable means such as, for example, winding around a motorized spool or pulling thereof by a suitable actuator.

The invention claimed is:

1. A vehicle opening panel emergency access device, comprising:

a graspable pull rod that is equipped with a retention strike and that is connected to a lock actuator, this graspable pull rod being designed to occupy: a retracted position in which the graspable pull rod is stowed in a sheath, and a deployed position in which the graspable pull rod is outside the sheath;

a first elastic member that urges the graspable pull rod toward its deployed position;

a retention lever that pivots relative to the sheath and has a bolt, the retention lever being designed to occupy: a blocking position in which the bolt is disposed in the retention strike, keeping the graspable pull rod in its retracted position, and a release position for releasing the graspable pull rod in which the bolt is outside the retention strike;

a second elastic member that urges the retention lever toward its blocking position;

a pull wire connected to the retention lever and designed to urge the retention lever by pulling it toward its release position;

the graspable pull rod being mounted so as to be able to move in translation in the sheath according to three modes:

a manual driving-in mode in which the graspable pull rod is pushed back into the sheath against the first elastic member, the retention strike urging the retention lever by pivoting it toward its release position, against the second elastic member;

a controlled driving-in mode in which the pull wire urges the retention lever by pulling it toward its release position, the graspable pull rod being pushed back into the sheath, against the first elastic member, by the bolt driving the retention strike;

an ejection mode in which the graspable pull rod is moved in translation in an ejection direction, under the effect of the first elastic member, from its stowed position toward its ejected position.

2. The device as claimed in claim 1, wherein the pull wire is made of shape memory alloy, the retention lever being pulled toward its release position by shortening of the pull wire.

3. The device as claimed in claim 2, further comprising a means for heating the pull wire by circulation of an electric current in the pull wire.

4. The device as claimed in claim 1, wherein the pull wire has two ends fastened side by side to a stop, the pull wire surrounding the retention lever at a groove.

5. The device as claimed in claim 4, wherein the groove has a double curvature with orthogonal axes.

6. The device as claimed in claim 5, wherein the groove is framed by two flanges for restraining the pull wire when the retention lever is in its release position.

7. The device as claimed in claim 4, wherein the groove is framed by two flanges for restraining the pull wire when the retention lever is in its release position.

8. The device as claimed in claim 4, wherein the two ends of the pull wire are crimped onto electrical connectors fastened in the stop.

9. The device as claimed in claim 1, wherein the retention strike has two opposite walls respectively defining a manual triggering surface and a controlled triggering surface; the bolt being blocked against the controlled triggering wall when the retention lever is in its blocking position; the manual triggering surface urging the retention lever by pivoting it toward its release position during the manual driving-in mode; the bolt pushing the controlled triggering surface back during the controlled driving-in mode.

10. The device as claimed in claim 9, wherein the bolt has an oblique surface that cooperates with the controlled triggering surface.

11. The device as claimed in claim 10, wherein the controlled triggering surface has the same inclination as the oblique surface of the bolt.

12. The device as claimed in claim 9, wherein the manual triggering surface is oblique and forms a track for the bolt during the manual driving-in mode.

13. A motor vehicle door, comprising a vehicle opening panel emergency access device as claimed in claim 1.

14. A motor vehicle, comprising a vehicle opening panel emergency access device as claimed in claim 1.

* * * * *